US006074044A

United States Patent [19]

Suetsugu et al.

[11] Patent Number: 6,074,044

[45] **Date of Patent: *Jun. 13, 2000**

[54] ELECTROSTATIC INK JET RECORDING HEAD USING CONTROL AND RECORDING ELECTRODES FOR EJECTING TONER PARTICLES

[75] Inventors: Junichi Suetsugu; Kazuo Shima; Yoshihiro Hagiwara; Ryosuke Uematsu; Hitoshi Minemoto; Toru Yakushiji; Hitoshi Takemoto; Tadashi Mizoguchi, all of Niigata, Japan

[73] Assignee: NEC Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/901,135

[22] Filed: Jul. 28, 1997

[30] Foreign Application Priority Data

Jul. 29, 1996 [JP] Japan ..... 8-198795

[51] Int. Cl.[7] ..... B41J 2/04

[52] U.S. Cl. ..... 347/55

[58] Field of Search ..... 347/55, 84, 103, 347/68, 70, 71, 154, 123, 111, 159, 127, 128, 17, 141, 120, 151; 399/290, 271, 292, 293, 294, 295

[56] References Cited

U.S. PATENT DOCUMENTS 4,271,416 6/1981 Shimizu et al. .

5,748,212 5/1998 Takagi ..... 347/55

FOREIGN PATENT DOCUMENTS 0 750 989 1/1997 European Pat. Off. .
0 778 138 6/1997 European Pat. Off. .
60-228162 11/1985 Japan .
8-309993 11/1996 Japan .
93/11866 6/1993 WIPO .

OTHER PUBLICATIONS

Patent Abstracts of Japan, vol. 006, No. 89 (M–132) May 27, 1982 (Abstract of JP 57 027759—Feb. 15, 1982).

*Primary Examiner*—John E. Barlow, Jr.
*Assistant Examiner*—Raquel Yvette Gordon
*Attorney, Agent, or Firm*—Foley & Lardner

[57] ABSTRACT

An electrostatic ink jet recording head has a laminate structure for an electrode assembly disposed in an ink chamber of a head body. The laminate structure includes a first base film, a plurality of patterned recording electrodes, a plurality of patterned control electrodes and a second base film. The recording electrodes and control electrodes are alternately arranged one by one as viewed perpendicular to the laminate. The tips of the recording electrodes are located ahead of the tips of the control electrodes toward the opposite electrode. In operation, the control electrodes located on both sides of a specified recording electrode are applied with a high voltage pulse to eject liquid ink from the meniscus in the vicinity of the specified recording electrode. The ink jet recording head can be manufactured at low costs and with a higher density.

5 Claims, 3 Drawing Sheets

ELECTROSTATIC INK JET RECORDING HEAD USING CONTROL AND RECORDING ELECTRODES FOR EJECTING TONER PARTICLES

BACKGROUND OF THE INVENTION (a) Field of the Invention

The present invention relates to an electrostatic ink jet recording head and, more particularly, to an electrostatic ink jet recording head having an improved configuration of electrodes for ejecting toner particles to a recording medium.

(b) Description of the Related Art

Non-impact recording technique attracts special attention because of its remarkable low noise operation. Among other non-impact recording heads, an ink jet recording head has several advantages of high-speed recording, simple mechanism, direct recording onto a plain paper etc. Various mechanisms for the ink jet recording head have been proposed.

Examples of the ink jet recording head include an electrostatic ink jet recording head in which a voltage is applied between an opposite electrode installed in the rear side of a recording medium and a plurality of ejecting electrodes or recording electrodes of a head body opposed to the opposite electrode with the recording medium disposed therebetween. FIG. 1 shows a head body of this type of the conventional electrostatic ink jet recording head described in a Japanese Patent Application No. 07-120252 in a perspective view, and FIGS. 2A and 2B show detailed plan view and cross-sectional view, respectively, of the front edge portion of the head body of FIG. 1.

The head body of the ink jet recording head comprises an insulator substrate 31 made of glass, for example, on which a plurality of recording electrodes 32 are formed by sputtering of a metal such as chrome (Cr) and subsequent patterning thereof by using a photolithographic technology. The recording electrodes 32 are arranged in a 300 dpi (dot per inch) pitch, i.e., about 85 $\mu$m pitch. The recording electrodes 32 are connected to a printing driver not shown in the drawings, and selectively applied therefrom with a high voltage pulse during a recording operation.

Meniscus elements 33 overlap the respective recording electrodes 32 except for the tip portion thereof for forming an ink meniscus in the vicinity of the recording electrodes 32. The meniscus elements 33 are made of a photosensitive polymer film laminated on the insulator substrate 31 and patterned by a photolithographic technology. Both the thickness and width of the meniscus elements 33 are about 30 $\mu$m. A top cover plate 34 is disposed above the meniscus element 33, and the front edge of the cover plate 34 is slightly retreated from the tip of the meniscus elements 33. The top cover plate 34 is made of an insulator material and has an ink inlet port 35 and an ink outlet port 36 therein. The gap between the front edge portions of the insulator substrate 31 and the top cover plate 34 constitutes an ink jet slit 37, from which the meniscus elements 33 protrude together with the tips of the recording electrodes 32. The meniscus elements 33 extend backwards below the cover plate 34 for supporting the same. A side wall 40 extending along the side edges and rear edge of the head body is formed, together with the meniscus elements 33 during fabrication process, for defining an ink chamber together with the insulator substrate 31 and top cover plate 34.

The conventional electrostatic ink jet recording head as described above has a disadvantage in that it is expensive because of the complicated manufacturing process therefor, especially for the process for forming the meniscus elements 33. It also has a disadvantage in that the electrode structure is difficult to be arranged in a higher density.

SUMMARY OF THE INVENTION

It is an object of the present invention to provide an ink jet recording head manufactured at a relatively low cost and with a higher density.

In accordance with the present invention there is provided an electrostatic ink jet recording head comprising: a head body including a substrate, a laminate overlying the substrate, and a top cover plate overlying the laminate for defining an ink chamber receiving liquid ink and an ink jet slit between the top cover plate and the laminate; and an opposite electrode disposed opposite to the ink jet slit, wherein the laminate includes a first base film, and a plurality of recording electrodes and a plurality of control electrodes supported by the first base film, wherein the recording electrodes and control electrodes are arranged alternately, and extend in a direction perpendicular to the ink jet slit and substantially parallel to each other, and wherein each of the recording electrodes has a tip located ahead of a tip of each of the control electrodes.

The electrostatic ink jet recording head according to the present invention can be formed at a relatively low cost and with a higher density in the electrode assembly because the meniscus elements are not provided therein and the control electrodes provided therein can be formed in a simple process. The control electrodes can be formed similarly to the recording electrodes or can be formed by successive steps for the electrode assembly.

The above and other objects, features and advantages of the present invention will be more apparent from the following description, referring to the accompanying drawings.

PREFERRED EMBODIMENTS OF THE INVENTION

Figure 1:
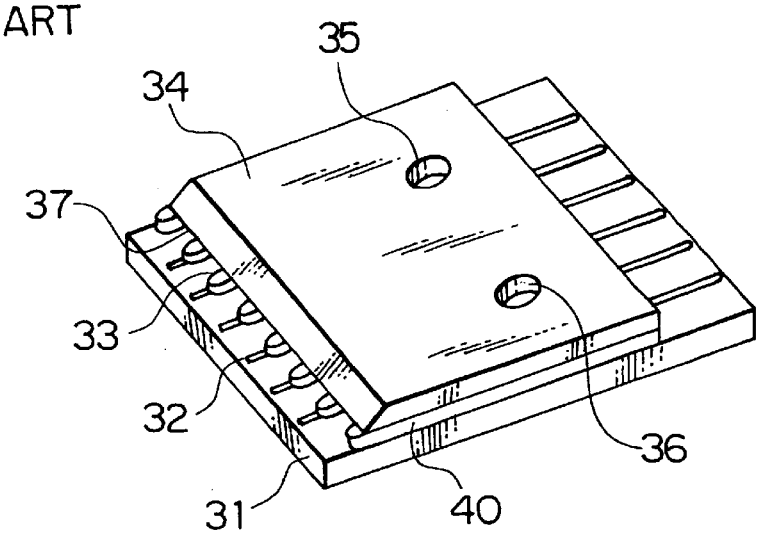
FIG. 1 PRIOR ART
FIG. 1 is a perspective view of a head body of a conventional electrostatic ink jet recording head.
Figure 2A:
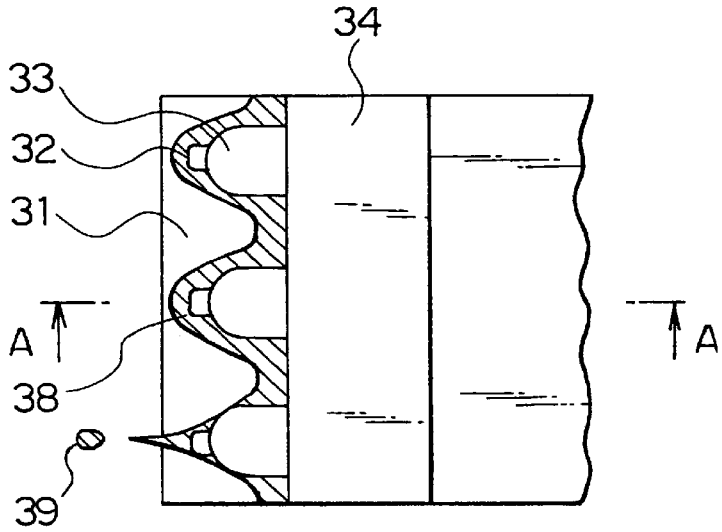
FIG. 2A is a detailed plan view of a front edge portion of the head body of FIG. 1.
Figure 2B:
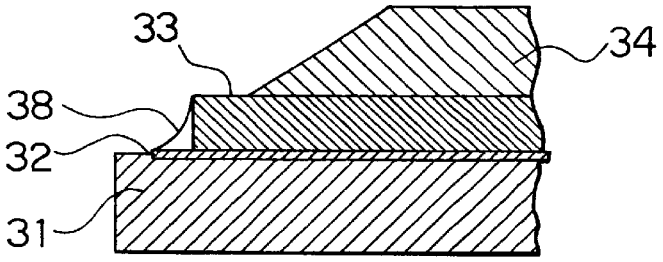
FIG. 2B is a cross-sectional view taken along line A—A in FIG. 2A.

Now, the present invention is more specifically described swith reference to accompanying drawings, wherein similar constituent elements are designated by the same or similar reference numerals.

Figure 3:
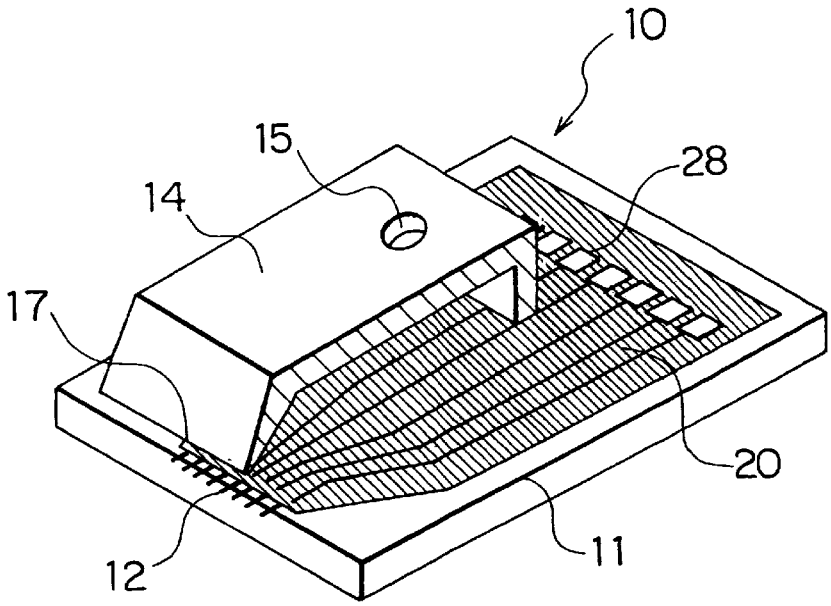
FIG. 3 is a partially cut-out perspective view of a head body of an electrostatic ink jet recording head according to an embodiment of the present invention.

Referring to FIGS. 3, a head body, generally designated at numeral 10, of the electrostatic ink jet head according to an embodiment of the present invention comprises an insulator substrate 11, a laminate structure constituting an electrode assembly and disposed on the insulator substrate 11, and a top cover plate 14 for substantially sandwiching the laminate structure of the electrode assembly between the top cover plate 14 and the substrate 11, the top cover plate 14 defining together with the laminate structure an ink chamber for receiving therein liquid ink containing toner particles.

Figure 4:
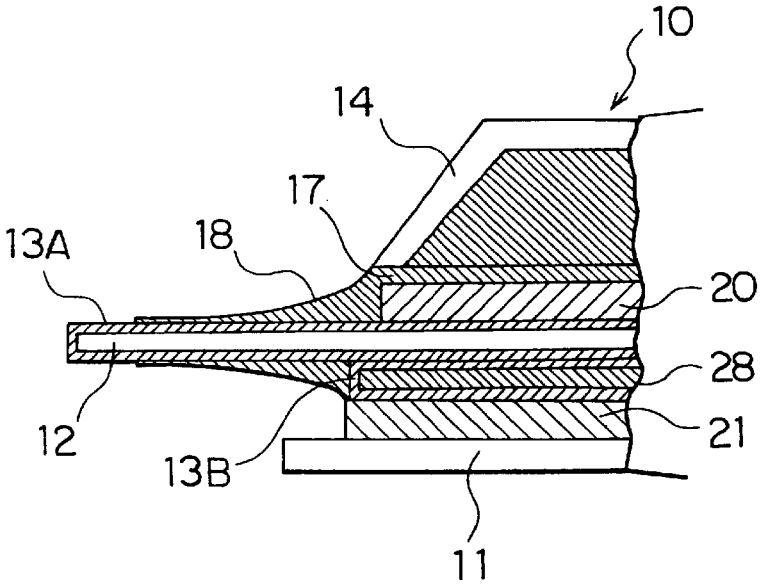
FIG. 4 is a cross-sectional view of a front edge portion of the head body FIG. 3, taken along line IV—IV in FIG. 5.

Referring additionally to FIG. 4, the laminate structure for the electrode assembly includes consecutively, as viewed from the top, a first base film 20 made of an insulator material underlying the top cover plate 14, a plurality of needle-shaped recording electrodes 12 extending parallel to each other and coated on the tip portions thereof with an insulator film 13A, a plurality of needle-shaped control electrodes 28 extending substantially parallel to each other and to the recording electrodes 12 and coated on the tip portions thereof with an insulator film 13B, and a second base film 21 disposed on the insulator substrate 11.

The tip of each recording electrodes 12 protrudes from the gap or ink jet slit 17 formed between the front edge portions of the insulator substrate 11 and top cover plate 14. The front edge of the insulator substrate 11 is located slightly ahead of the front edge of the top cover plate 14, front edges of the first and base films 20 and 21 and the tips of the control electrodes 28, all of which are substantially aligned with each other in the extending direction of the recording electrodes 12.

The substrate 11 is made of an insulator such as a plastic resin, and the first base film 20 is also made of an insulator, such as polyimide, having a thickness of about 50 $\mu$m. The recording electrodes 12 are formed on the first base film 20 by pattern-plating of a metal, such as Cu, to a thickness of about 20 to 30 $\mu$m. The recording electrodes 12 are arranged in a horizontal direction perpendicular to the extending direction of the recording electrodes 12 at a 300 dpi, or 85 $\mu$m pitch. The tips of the recording electrodes are located about 80 to 500 $\mu$m ahead of the front edge of the first base film 20. The insulating film 13A coating the tip portions of the recording electrodes 12 has a uniform thickness of about 10 $\mu$m or less.

The second base film 21 is made of an insulator, such as polyimide similarly to the first base film 20, having a thickness of about 50 $\mu$m. The control electrodes 28 are formed on the second base film 21 by pattern-plating of a metal, such as Cu, to a thickness of 20 to 30 $\mu$m. The control electrodes 18 are arranged in the horizontal direction perpendicular to the extending direction of the control electrodes 28 at a 300 dpi pitch, or 85 $\mu$m pitch, similarly to the recording electrodes 12. The control electrodes 28 are coated on the tip portions thereof with an insulating film 13B having a uniform thickness of 10 $\mu$m or less. The first and second base films 20 and 21 are bonded together so that the control electrodes 28 and recording electrodes 12 are arranged alternately one by one at a constant pitch as viewed in the vertical direction, although the recording electrodes 12 and control electrodes 28 are arranged in separate planes.

The laminate structure for the electrode assembly of the electrostatic ink jet recording head of the present embodiment can be made from film tapes generally used in a TAB (tape automated bonding) technique and herein called TAB tapes. The insulator films 13A and 13B for coating the tip portions of the recording electrodes 12 and control electrodes 28 are formed by chemical evaporation of parylene resin, for example.

The top cover plate 14 is made of an insulator and covers the laminate structure of the electrode assembly except for the tip portions and rear end portions of the recording electrodes. The rear ends of the recording electrodes 12 and control electrodes are formed as terminals for connection. The top cover plate 14 has an ink inlet port 15 and an ink outlet port similarly to the conventional head body. The space between the first base film 20 and the top cover plate 14 forms an ink chamber which is filled with liquid ink introduced through the ink inlet port 15. The ink jet silt 17 is formed as a gap between the front edge of the top cover plate 14 and the front edge of the first base film 20.

The ink chamber of the jet recording head of the present embodiment is connected to an ink reservoir (not shown) with a pair of tubes for circulation of liquid ink. The ink chamber is subjected to a negative pressure of about 1 $cmH_2O$. The liquid ink is generally obtained by dispersing colored thermosetting resin particles and a charge control agent into a petroleum organic solvent such as isoparaffine, wherein toner particles have a pseudo positive potential due to zeta potential.

Figure 5:
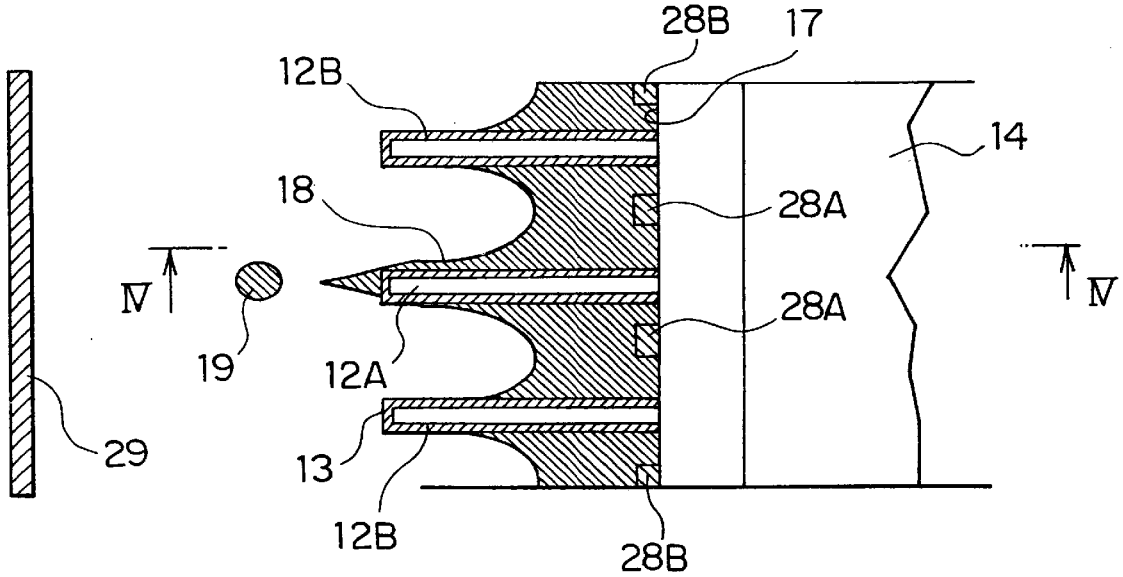
FIG. 5 is a top plan view of the front edge portion of FIG. 4, additionally showing an opposite electrode.

Liquid ink forms an ink meniscus 18 adjacent to the ink jet slit 17 due to the surface tension. As shown in FIGS. 4 and 5, the ink meniscus 18 is formed ahead of the ink jet slit 17 and has a protrusion around the tip of each of the recording electrodes 12. The negative pressure of the ink chamber and the tips of the recording electrodes 12 protruding from the front edge of the top cover plate 14 provide a shape for the ink meniscus 18 such that the edge of the ink meniscus 18 has a concave curve as viewed in the horizontal direction (see FIG. 4). The protruding recording electrodes 12 provide a shape for the ink meniscus 18 such that the ink meniscus 18 has separate protrusions associated with respective recording electrodes 12, as viewed in the vertical direction (see FIG. 5).

In the vicinity of the front edge of the top cover plate 14, the alternate arrangement of the recording electrodes 12 and the control electrodes 28 defines a zigzag line at the tips of the electrodes 12 and 18, as shown in FIG. 5. During a recording operation, the recording electrodes 12 are maintained in a high-impedance state whereas the control electrodes 28 are connected to a printing driver (not shown) for driving the control electrodes. In order to eject liquid ink from the tip of a specified recording electrode 12A in FIG. 5, two control electrodes 28A located on both sides of the specified recording electrode 12A are applied with a high voltage pulse to generate a high electric field in the vicinity of the specified recording electrode 12A, which is maintained in the high impedance state as mentioned above.

The potential of the specified recording electrode 12A is raised up to a first potential substantially equal to the potential of both the control electrodes 28A disposed on both sides of the specified recording electrode 12A, the first potential being higher than the ejecting potential for the liquid ink. The first potential of the specified recording electrode 12A raises the electric field around the tip of the protrusion of the ink meniscus 18 in the vicinity of the specified recording electrode 12A. On the other hand, each of the recording electrodes 12B adjacent to the specified recording electrode 12A is maintained at a second potential between the potential of the control electrodes 28A applied with the high voltage pulse and other control electrode 28B located on the other side of the recording electrodes 12B, the second potential being lower than the ejecting potential for the liquid ink.

The toner particles contained in the liquid ink are ejected from the protrusion of the ink meniscus 18 adjacent to the specified recording electrode 12A, while forming an ink droplet 19, toward the opposite electrode 29 located behind a recording medium. The ejected ink droplet 19 reaches the recording medium, form a dot record thereon, and then thermally fixed by a heater.

In fabrication process of the above embodiment, the first base film 20 mounting the recording electrodes 12 and the second base film 21 mounting the control electrodes 28 are separately fabricated as a pair of TAB tapes and then bonded together before installation of the same into the head body.

Figure 6:
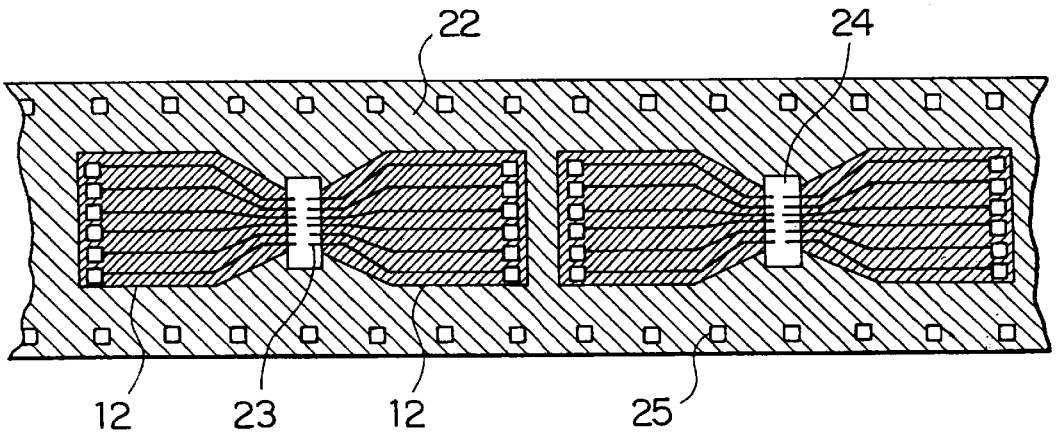
FIG. 6 is a top plan view of a TAB tape for manufacturing a laminate structure of an electrostatic ink jet recording head according to a second embodiment of the present invention.

FIG. 6 shows another example of a TAB tape used for mounting both the recording electrodes 12 and control electrodes 28 for the electrostatic ink jet recording head. The TAB tape of FIG. 6 can be formed as follows. First, a base film 22 made of polyimide is formed with a train of sprocket holes 25 at each side edge thereof. The base film 22 is then plated with a metallic film such as a Cu film (not shown) by a flashing technique, which is generally known for forming a thin film.

A dry photoresist film is then laminated on the metallic film, subjected to an exposure and development to form a patterned metallic film constituting a plurality of control electrodes. An insulating film is then formed thereon, followed by plating thereon a patterned metallic film such as a cu film constituting a plurality of recording electrodes 12. Subsequently, the base film 22 is subjected to patterning to form through-holes 24 by using a photoresist film. The photoresist film is then removed, followed by finishing plating of the recording electrodes 12. Then, the entire surface including the surfaces of the recording electrodes 12 is coated with an insulator material by using a chemical evaporation technique, to thereby obtain the TAB film of FIG. 6, wherein only the overlying recording electrodes 12 are depicted as the metallic layer. In FIG. 6, the tip portions 23 of the recording electrodes 12 are shown as protruding from the base film 22 to the through-holes 24.

Figure 7:
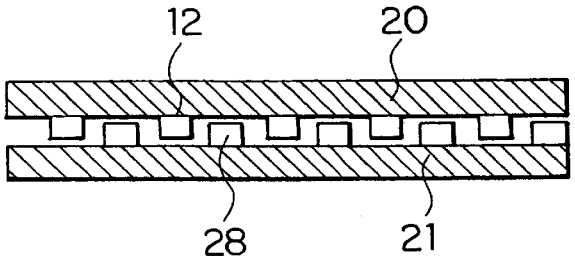
FIG. 7 is a elevational view of a front edge of a laminate in an electrostatic ink jet recording head according to a third embodiment of the present invention.

FIG. 7 shows another example of the laminate structure for the electrode assembly of an electrostatic ink jet recording head according to a third embodiment of the present invention. The laminate structure is shown as viewed from the front of the recording head. In this embodiment, the laminate structure for the electrode assembly has a first base film 20 supporting a plurality of recording electrodes 12 and a second base film 21 supporting a plurality of control electrodes 28 which are substantially arranged in a common plane with the recording electrodes 12. A thin insulating coat film not specifically shown in the figure overlies each of the recording electrodes 12 and control electrodes 28. The recording electrodes 12 and control electrodes 28 are alternately arranged one by one in the substantially common plane. In this configuration, the laminate structure can be formed to have a small thickness, whereby the ink meniscus can be more efficiently held at the front edge of the top cover plate.

Since the above embodiments are described only for examples, the present invention is not limited to the above embodiments and various modifications or alterations can be easily made therefrom by those skilled in the art without departing from the scope of the present invention.

What is claimed is:

1. An electrostatic ink jet recording head comprising:

a head body including a substrate, a laminate overlying said substrate, and a top cover plate overlying said laminate, said laminate including a first base film adjacent said top cover plate, a plurality of recording electrodes formed on a lower surface of said first base film, a second base film adjacent said substrate, and a plurality of control electrodes formed on an upper surface of said second base film, said laminate and said top cover plate defining therebetween an ink chamber for receiving liquid ink, and a front edge of said top cover plate and a front edge of said first base film defining an ink jet slit; and an opposite electrode disposed opposite to said ink jet slit, wherein said recording electrodes and said control electrodes are arranged alternately and extend in a direction perpendicular to said ink jet slit and extend substantially parallel to each other, and wherein each of said recording electrodes has a tip located ahead of a tip of each of said control electrodes such that any said tip of said recording electrodes is closer to said opposite electrode than any said tip of said control electrodes.

2. An electrostatic ink jet recording head as defined in claim 1 wherein said recording electrodes are held in a high-impedance state and a pair of said control electrodes are selectively applied with a driving voltage during a recording operation.

3. An electrostatic ink jet recording head as defined in claim 1 wherein said recording electrodes and said control electrodes are arranged in separate planes.

4. An electrostatic ink jet recording head as defined in claim 1 wherein said recording electrodes and said control electrodes are arranged substantially in a common plane.

5. An electrostatic ink jet recording head as defined in claim 1 wherein each of said recording electrodes has a tip located 80 to 500 $\mu$m ahead of tips of said control electrodes in a direction toward said opposite electrode.

* * * * *